US008875783B2

(12) United States Patent
Giroux et al.

(10) Patent No.: US 8,875,783 B2
(45) Date of Patent: Nov. 4, 2014

(54) EXPANSION SYSTEM FOR AN EXPANDABLE TUBULAR ASSEMBLY

(75) Inventors: Richard Lee Giroux, Cypress, TX (US); Varadaraju Gandikota, Cypress, TX (US); Nader E. Abedrabbo, Cypress, TX (US); Larry A. Kendziora, Needville, TX (US); Lev Ring, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 633 days.

(21) Appl. No.: 13/095,839

(22) Filed: Apr. 27, 2011

(65) Prior Publication Data

US 2012/0273237 A1 Nov. 1, 2012

(51) Int. Cl.
*E21B 23/00* (2006.01)
*E21B 43/10* (2006.01)

(52) U.S. Cl.
CPC ..... *E21B 43/103* (2013.01)
USPC ..... 166/207; 166/217; 166/382; 166/384

(58) Field of Classification Search
USPC ..... 166/207, 382, 88.2, 206, 216, 217, 384
See application file for complete search history.

(56) References Cited

U.S. PATENT DOCUMENTS 6,457,532 B1 10/2002 Simpson
6,702,030 B2 * 3/2004 Simpson ..... 166/380
6,860,329 B1 3/2005 Oosterling
7,077,210 B2 * 7/2006 MacKay et al. ..... 166/380
7,121,351 B2 10/2006 Luke et al.
7,152,684 B2 12/2006 Harrall et al.
7,172,024 B2 2/2007 Cook et al.
7,255,177 B2 8/2007 Duggan et al.
7,367,389 B2 5/2008 Duggan et al.
7,383,889 B2 6/2008 Ring et al.
7,395,857 B2 7/2008 Hillis
7,497,255 B2 3/2009 Filippov et al.
7,503,396 B2 * 3/2009 Hester ..... 166/384
7,543,639 B2 6/2009 Emerson (Continued)

FOREIGN PATENT DOCUMENTS

EP 1942248 A1 7/2008
GB 2401131 A 11/2004
GB 2403748 A 1/2005
WO 03056125 A2 7/2003

OTHER PUBLICATIONS

PCT International Search Report dated Oct. 11, 2013, International Application No. PCT/US2012/035455.

*Primary Examiner* — Kenneth L Thompson
*Assistant Examiner* — Michael Wills, III
(74) *Attorney, Agent, or Firm* — Patterson & Sheridan LLP

(57) ABSTRACT

The present invention generally relates to an apparatus and method for expanding an expandable tubular assembly in a borehole. In one aspect, a system for expanding a tubular having an anchor portion in a borehole is provided. The system includes a running tool configured to position the tubular in the borehole. The running tool including a first expander configured to activate the anchor portion by expanding the tubular to a first diameter. The system further includes a second expander configured to expand the tubular to a second larger diameter, wherein the second expander is movable between a retracted position and an expanded position. In another aspect, a method of expanding a tubular having an anchor portion in a borehole is provided.

22 Claims, 18 Drawing Sheets

(56) References Cited

U.S. PATENT DOCUMENTS

| | | | | |
|---|---|---|---|---|
| 7,779,923 | B2 | 8/2010 | Holland et al. | |
| 2003/0127225 | A1* | 7/2003 | Harrall et al. | 166/285 |
| 2004/0216878 | A1* | 11/2004 | Metcalfe et al. | 166/285 |
| 2008/0156499 | A1 | 7/2008 | Giroux et al. | |
| 2009/0266560 | A1 | 10/2009 | Ring et al. | |
| 2012/0037381 | A1* | 2/2012 | Giroux et al. | 166/382 |

* cited by examiner

EXPANSION SYSTEM FOR AN EXPANDABLE TUBULAR ASSEMBLY

BACKGROUND OF THE INVENTION

1. Field of the Invention

The present invention relates to wellbore completion. More particularly, the invention relates to an apparatus and method for expanding an expandable tubular assembly in a borehole.

2. Description of the Related Art

Expandable technology enables a smaller-diameter tubular to pass through a larger-diameter tubular, and thereafter be expanded to a larger diameter. In this respect, expandable technology permits the formation of a tubular string having a substantially constant inner diameter. When an expandable tubular is run into a borehole, it must be anchored within the borehole at the desired depth to prevent movement of the expandable tubular during the expansion process. Anchoring the expandable tubular within the borehole allows expansion of the length of the expandable tubular in the borehole.

The expandable tubular that is used to isolate the area of interest is often run into the borehole after previous strings of casing (e.g., parent casing) are already set within the borehole. The expandable tubular for isolating the area of interest must be run through the inner diameter of the parent casing to reach the portion of the open-hole borehole slated for isolation, which is located below the previously set parent casing. Accordingly, the outer diameter of the anchor and the expandable tubular must be smaller than the parent casing in the borehole in order to run through the parent casing to the depth at which the open-hole borehole exists. After locating the expandable tubular below the parent casing, a conventional expander tool is pushed or pulled through the expandable tubular to expand the anchor and the expandable tubular into contact with the surrounding borehole.

Oftentimes, it is desired to have the inner diameter of the expandable tubular to be at least as large as the inner diameter of the parent casing so that drilling can continue with the same drill bit. To achieve an inner diameter of the expandable tubular to be at least as large as the inner diameter of the parent casing, the expandable tubular may require a 28% expansion ratio. However, the conventional expander tool can typically obtain a 20% expansion ratio. Therefore, there is a need for an expansion system for expanding the expandable tubular to the required expansion ratio.

SUMMARY OF THE INVENTION

The present invention generally relates to an apparatus and method for expanding an expandable tubular assembly in a borehole. In one aspect, a system for expanding a tubular having an anchor portion in a borehole is provided. The system includes a running tool configured to position the tubular in the borehole. The running tool including a first expander configured to activate the anchor portion by expanding the tubular to a first diameter. The system further includes a second expander configured to expand the tubular to a second larger diameter, wherein the second expander is movable between a retracted position and an expanded position.

In another aspect, a method of expanding a tubular having an anchor portion in a borehole is provided. The method includes the step of positioning the tubular in the borehole using a running tool that includes a first expander and an engagement device for retaining the tubular. The method further includes the step of activating the anchor portion by expanding a portion of the tubular to a first diameter using the first expander while the engagement device supports the tubular. The method also includes the step of releasing the engagement device from the tubular and expanding the remaining portion of the tubular to the first diameter using the first expander. Furthermore, the method includes the step of positioning a second expander in the tubular. Additionally, the method includes the step of expanding the tubular to a second larger diameter by using the second expander.

In a further aspect, a tool for expanding an open-hole anchor in a borehole is provided. The tool includes an engagement device configured to selectively engage the open-hole anchor. The tool further includes an expander configured to expand the open-hole anchor. Additionally, the tool includes one or more jacks configured to move the expander relative to the engagement device in order to expand an anchor portion of the open-hole anchor.

In an additional aspect, a system for use in a wellbore is provided. The system includes a tubular having an anchor portion. The system further includes a running tool configured to position the tubular in the wellbore, the running tool including a first expander configured to activate the anchor portion by expanding the tubular to a first diameter. The system also includes a second expander configured to expand the tubular to a second larger diameter, wherein the second expander is movable between a retracted position and an expanded position.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention generally relates to an expansion system for use with a tubular with an anchor. The expansion system will be described herein in relation to expanding the tubular into an open hole. It is to be understood, however, that the expansion system may also be used to expand the tubular inside of a cased borehole without departing from principles of the present invention. To better understand the novelty of the expansion system of the present invention and the methods of use thereof, reference is hereafter made to the accompanying drawings.

Figures 1A, 1B, 1C, 1D:
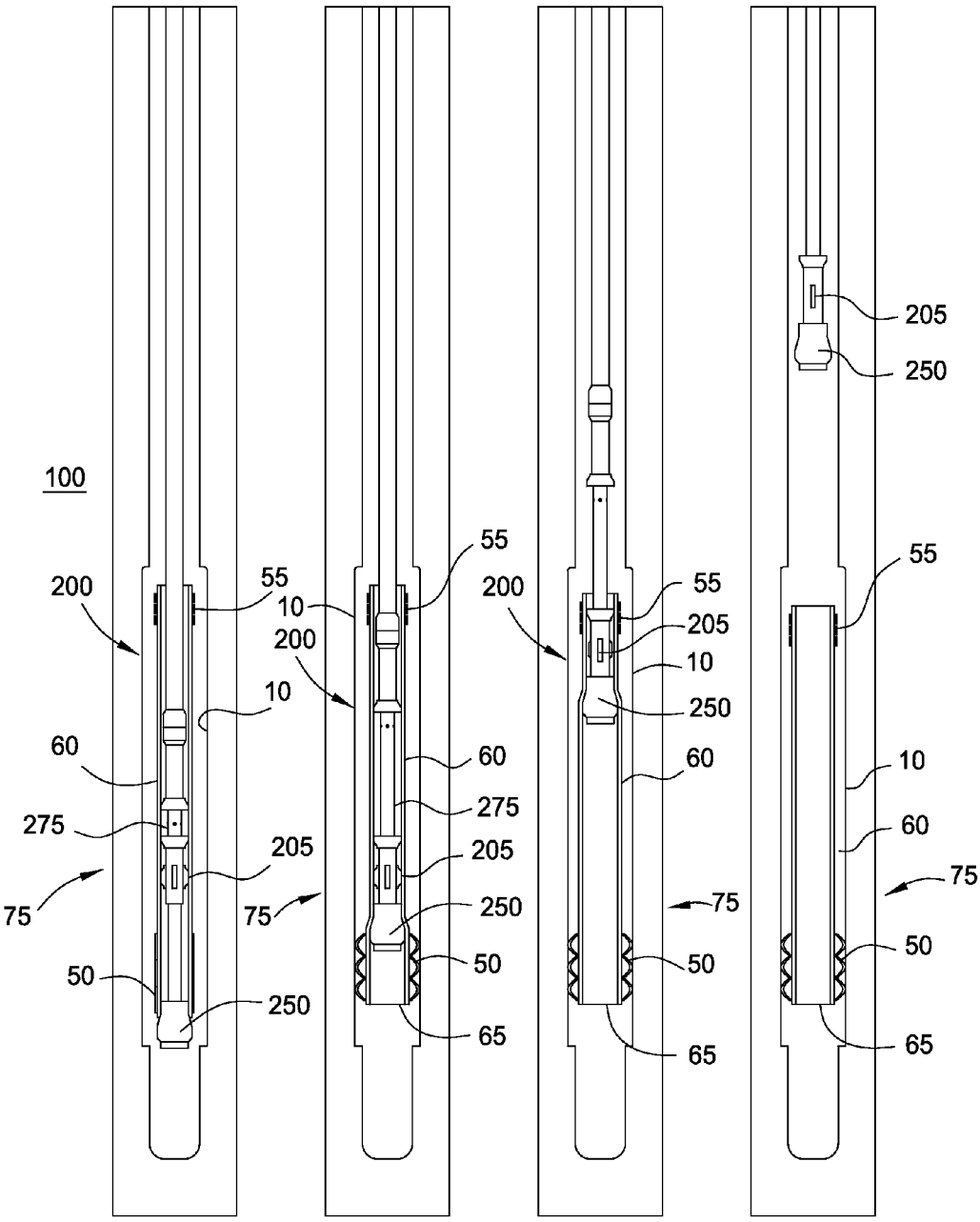
FIGS. 1A-1H are views illustrating the steps of expanding an expandable tubular assembly in a borehole using an expansion system.
Figures 1E, 1F, 1G, 1H:
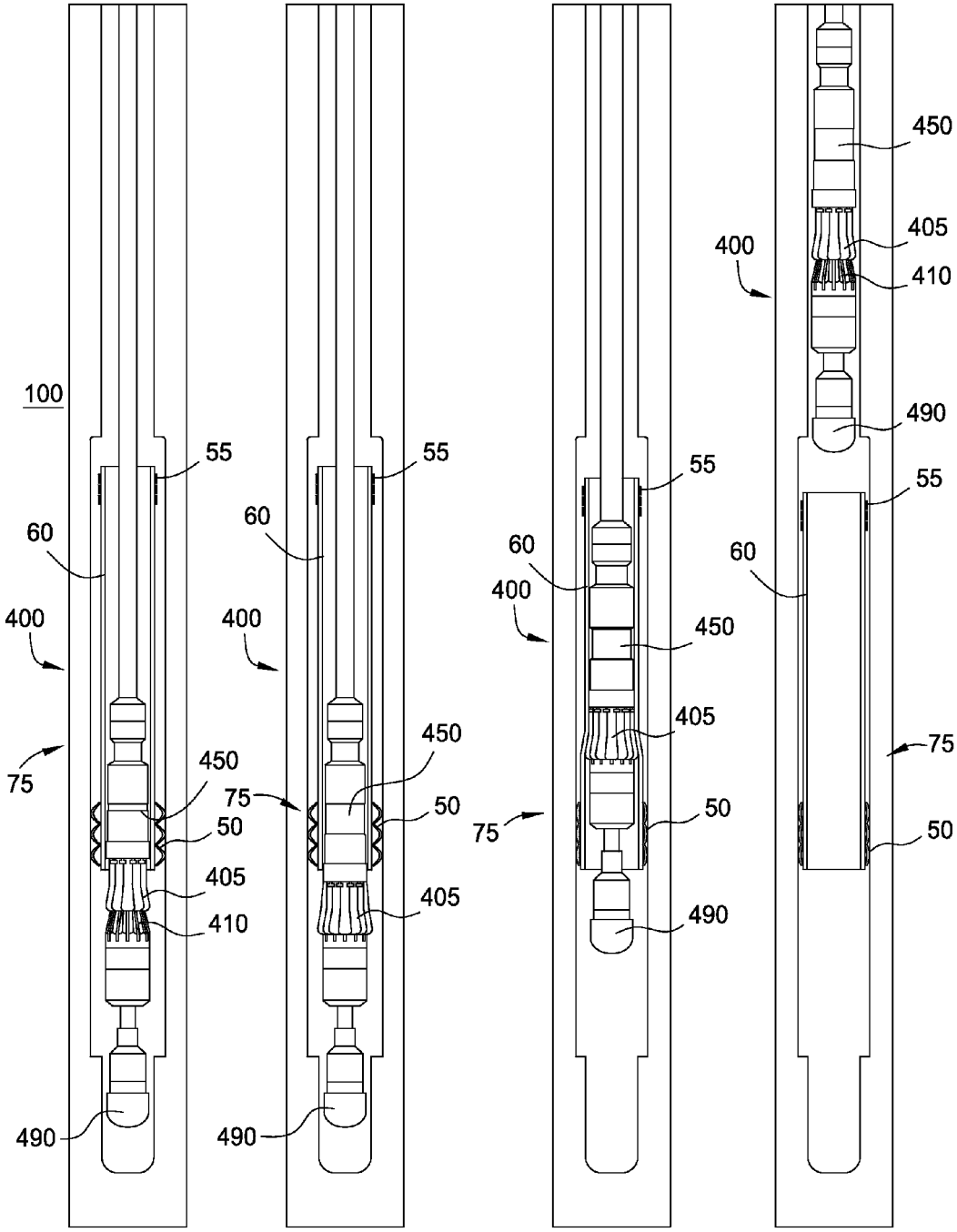

FIGS. 1A-1H generally illustrate the steps of an expansion operation that uses an expansion system 100 of the present invention. The details of the expansion system 100 will be described in FIGS. 2-13. The expansion of an expandable tubular assembly 75 is done in a first step and a second step to obtain a 28% expansion ratio. The first step is shown in FIGS. 1A-1D in which a running tool 200 of the expansion system 100 is used to expand the expandable tubular assembly 75 to a first diameter. The second step is shown in FIGS. 1E-1G in which an expander tool 400 of the expansion system 100 is used to expand the expandable tubular assembly 75 to a second larger diameter.

As shown in FIG. 1A, the expandable tubular assembly 75 is lowered into a borehole 10 attached to the running tool 200. The expandable tubular assembly 75 is positioned adjacent an under-reamed portion of the borehole 10. The expandable tubular assembly 75 is connected to the running tool 200 by a releasable engagement device 205, such as a latch, drag blocks, collet, slips, thread, shear member or any other suitable mechanism. The expandable tubular assembly 75 includes an anchor portion 50 and seals 55 disposed around a tubular 60. The seals 55 may be at any location on the tubular 60, such as both ends of the tubular 60. The releasable engagement device 205 is configured to support the expandable tubular assembly 75 while the anchor portion 50 is being activated. After activation, the anchor portion 50 is configured to support the expandable tubular assembly 75 in the borehole 10. Thereafter, the releasable engagement device 205 is released from the expandable tubular assembly 75. In one embodiment, the releasable engagement device 205 is automatically released from the expandable tubular assembly 75 once an expander 250 of the running tool 200 passes through the anchor portion 50. The anchor portion 50 is positioned between the engagement device 205 (i.e., fixed point) and an end 65 (i.e., free point) of the tubular 60. In one embodiment, the anchor portion 50 may comprise a plurality of bands, wherein each band has an end connected to the tubular 60. The bands will bow radially outward as the tubular 60 becomes axially shorter as the tubular 60 is expanded radially. In another embodiment, the anchor portion 50 is a slip arrangement.

FIG. 1B illustrates the expander 250 of the running tool 200 expanding the tubular 60 adjacent the anchor portion 50. The expander 250 is configured to move relative to the engagement device 205 by jacks 275 in order activate the anchor portion 50. The details of the jacks 275 will be explained in more detail in FIGS. 3 and 4. As the expander 250 expands the tubular 60, the length between the end 65 of the tubular 60 and the engagement device 205 changes from a first length to a second shorter length, which causes the anchor portion 50 to activate. In other words, the tubular 60 becomes axially shorter as the tubular 60 is expanded radially. The reduction in the length of the tubular 60 occurs between the fixed end (engagement device 205) and the free end 65.

FIG. 1C illustrates the expander 250 of the running tool 200 further expanding the tubular 60. The anchor portion 50 is configured to support the tubular 60 in the borehole 10 after the anchor portion 50 is activated, and thus the engagement device 205 may be released from the tubular 60. Thereafter, the expander 250 may be urged through the tubular 60 by mechanically pulling on the running tool 200, such as pulling the tool 200 from the surface of the borehole 10. FIG. 1D illustrates the removal of the running tool 200 after expansion of the expandable tubular assembly 75 to the first diameter. The expandable tubular assembly 75 may include an optional centralizer proximate an upper end of the tubular 60 to centralize the tubular 60 in the borehole 10. In one embodiment, the centralizer may comprise a plurality of fingers separated by slots formed at the upper end of the tubular 60. The fingers are configured to bend radially outward and engage the wellbore 10 as the expander 250 expands the tubular 60. In another embodiment, the centralizer may comprise a plurality of bands, wherein each band has an end connected to the tubular 60. The bands will bow radially outward as the tubular 60 is expanded radially outward by the expander 250. The centralizer may be useful in the positioning the tubular 60 in the borehole 10 to allow the expander tool 400 to be placed within the expandable tubular assembly 75 after the running tool 200 has been removed.

As shown in FIG. 1E, the expander tool 400 of the expansion system 100 is lowered into the expandable tubular assembly 75. The expander tool 400 optionally includes a device 490, such as a drill bit, a mill, brushes, a scraper, a filter member, a junk basket, or any other cleaning device, that may be used to remove (dislodge) debris or other material in the borehole 10 that may hinder the placement of the expander tool 400 in the expandable tubular assembly 75. The device 490 may also be used to drill or mill a portion of the borehole 10. The expander tool 400 includes a formable second expander 405 that is configured to move between a radially retracted position as shown in FIG. 1E and a radially expanded position as shown in FIG. 1F. As will be described herein, the second expander 405 moves from the retracted position and the expanded position through the use of a cylinder member 450 which urges a ramped portion 410 under the second expander 405. Other types of formable expanders may be used without departing from principles of the present invention. An example of an expander is described in U.S.

Pat. No. 7,121,351 entitled "Apparatus and method for completing a wellbore" to Mike Luke, which is incorporated herein by reference.

FIG. 1F illustrates the second expander 405 of the expander tool 400 in the expanded position. After the second expander 405 is moved to the expanded position, the expander tool 400 travels through the expandable tubular assembly 75 by mechanically pulling on the expander tool 400. As the second expander 405 moves through the tubular 60 adjacent the anchor portion 50, the tubular 60 is expanded to the second larger diameter which causes the anchor portion 50 to further engage the borehole 10 as shown in FIG. 1G.

FIG. 1H illustrates the expander tool 400 of the expansion system 100 being removed from the borehole 10 after expansion of the expandable tubular assembly 75. After the expandable tubular assembly 75 is expanded to the second larger diameter, the second expander 405 is moved from the expanded position to the retracted position by moving the ramped portion 410 away from the second expander 405. Thereafter, the expander tool 400 is removed from the borehole 10. In another embodiment, the expansion of the expandable tubular assembly 75 may be done in a single step to obtain a 28% expansion ratio by using the running tool 200 of the expansion system 100. In a further embodiment, the expandable tubular assembly 75 may be expanded in a non-enlarged portion of the borehole 10.

Figure 2:
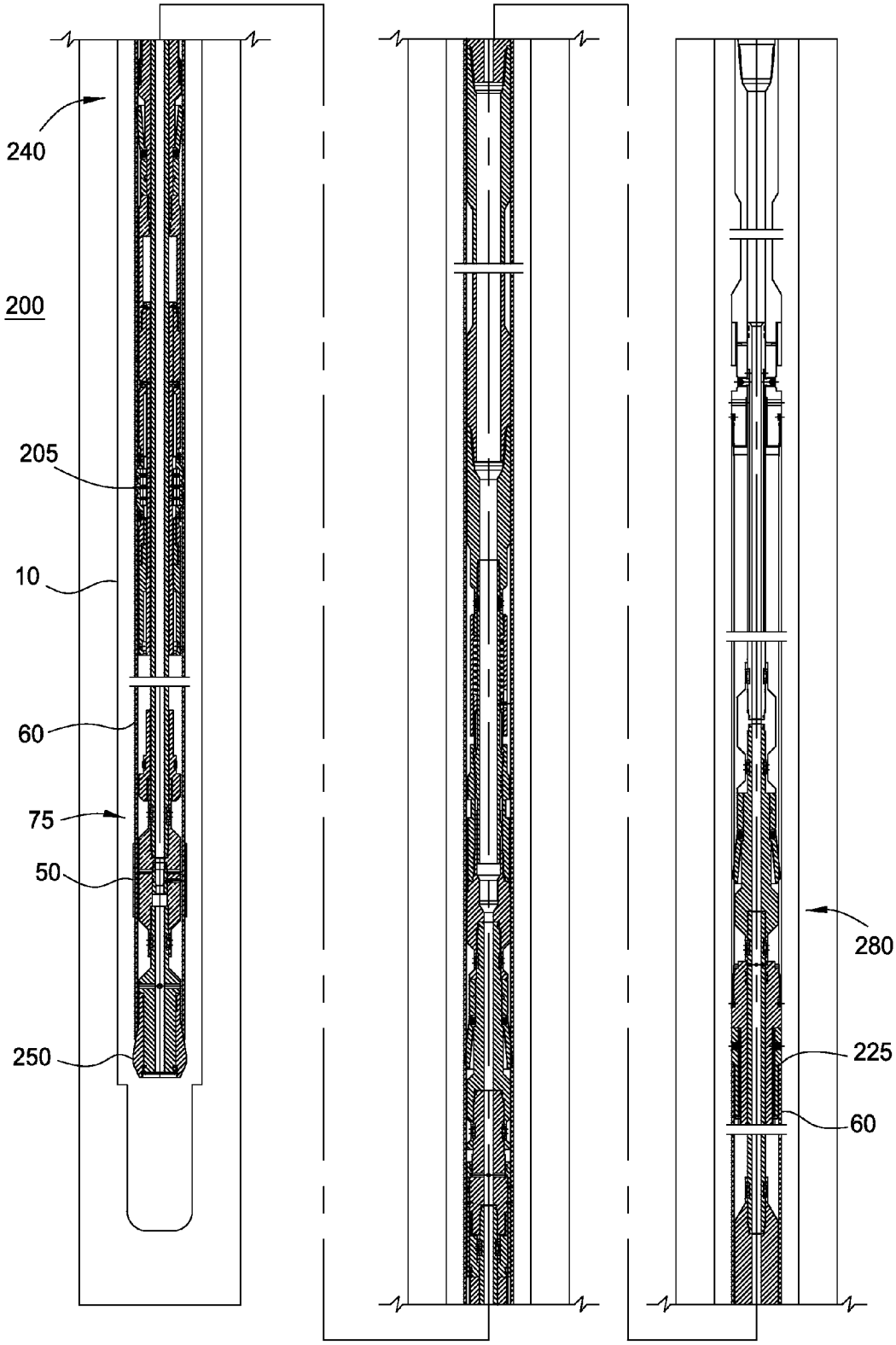
FIG. 2 is a view illustrating a running tool of the expansion system.

FIG. 2 is a view illustrating the running tool 200 in a run-in position. As shown in FIG. 2, the running tool 200 includes the expander 250 that is disposed below the tubular 60. The running tool 200 also includes the engagement device 205 which is shown as drag blocks. The sequence of releasing the drag blocks is illustrated in FIGS. 5A-5C.

The running tool 200 also includes a first jack 240 and a second jack 280 that move the expander 250 relative to the engagement device 205 in order to activate the anchor portion 50 of the expandable tubular assembly 75. The first and second jacks 240, 280 are configured to move the expander 250 through the expandable tubular assembly 75 while the engagement device 205 supports the expandable tubular assembly 75 in the borehole 10. The jacks 240, 280 work together to ensure that sufficient force is generated to move the expander 250 through the expandable tubular assembly 75. The jacks 240, 280 are configured to move (i.e., stroke) from a retracted position to an extended position. As the first jack 240 moves from the retracted position to the extended position, a portion of the jack 240 is supported by the engagement device 205. As the second jack 280 moves from the retracted position to the extended position, a portion of the jack 280 is supported by a support shoulder 225 that engages an upper portion of the tubular 60 of the expandable tubular assembly 75. Although the running tool 200 in FIG. 2 shows two jacks, any number of jacks may be attached to the expander 250 without departing from principles of the present invention.

Figure 3:
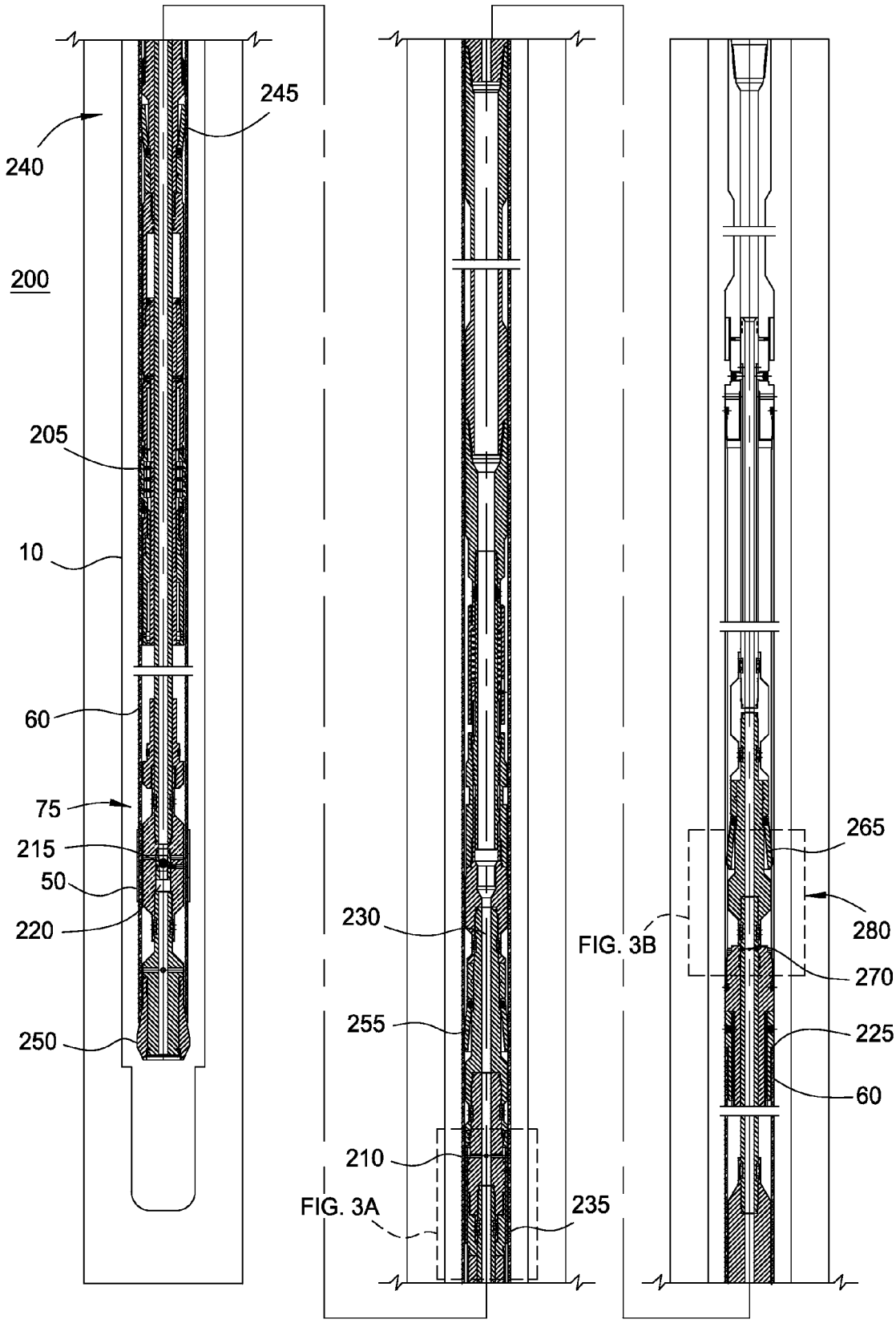
FIG. 3 is a view illustrating the activation of a first jack and a second jack in the running tool.
Figure 3A:
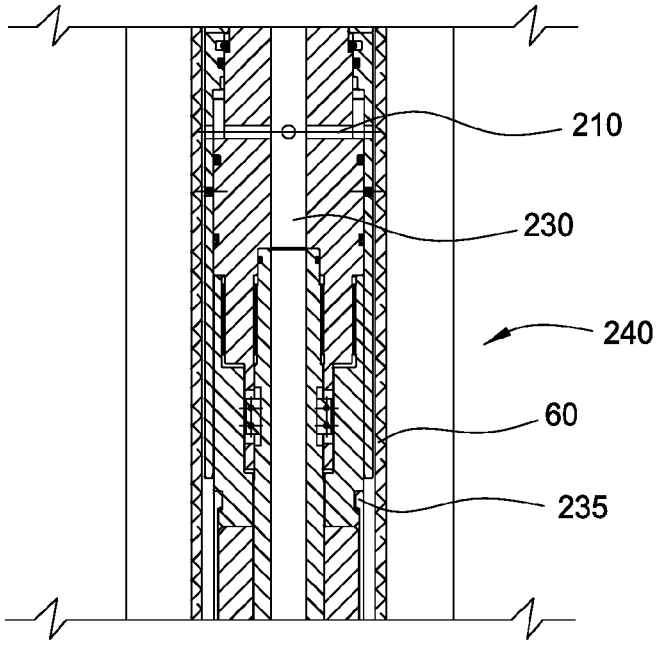
FIG. 3A is an enlarged view illustrating the first jack.
Figure 3B:
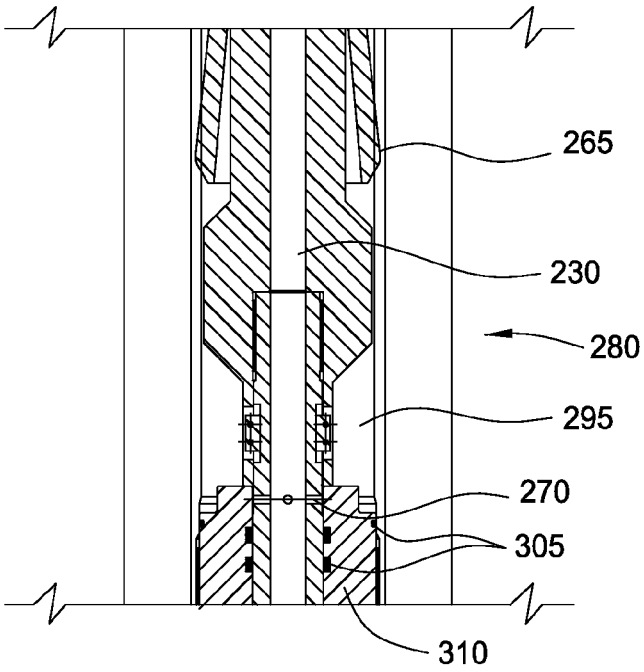
FIG. 3B is an enlarged view illustrating the second jack.

FIG. 3 is a view illustrating the running tool 200 when the first jack 240 and the second jack 280 are activated. To activate the jacks 240, 280, a blocking member 215, such as a ball or a dart, is dropped into a bore 230 in the running tool 200 and lands on a seat 220 which blocks the flow of fluid through the running tool 200 (see FIG. 5D for an enlarged view of the blocking member 215 and the seat 220). Thereafter, fluid is pumped into the running tool 200 to increase the pressure in the bore 230 of the running tool 200. At a predetermined pressure, collet retainer 235 moves to open a port 210 between a first cup 245 and a second cup 255 of the jack 240. FIG. 3A illustrates an enlarged view of the port 210 and collet retainer 235 in the first jack 240. FIG. 3B illustrates an enlarged view of a port 270 and a cup 265 of the second jack 280. In a similar manner, the port 270 is opened adjacent the cup 265 of the second jack 280. The port 270 is used as a fluid pathway between the bore 230 and a chamber 295 of the second jack 280. As shown in FIG. 3B, the chamber 295 is defined between the cup 265 and seals 305 disposed on an annular member 310.

Figure 4:
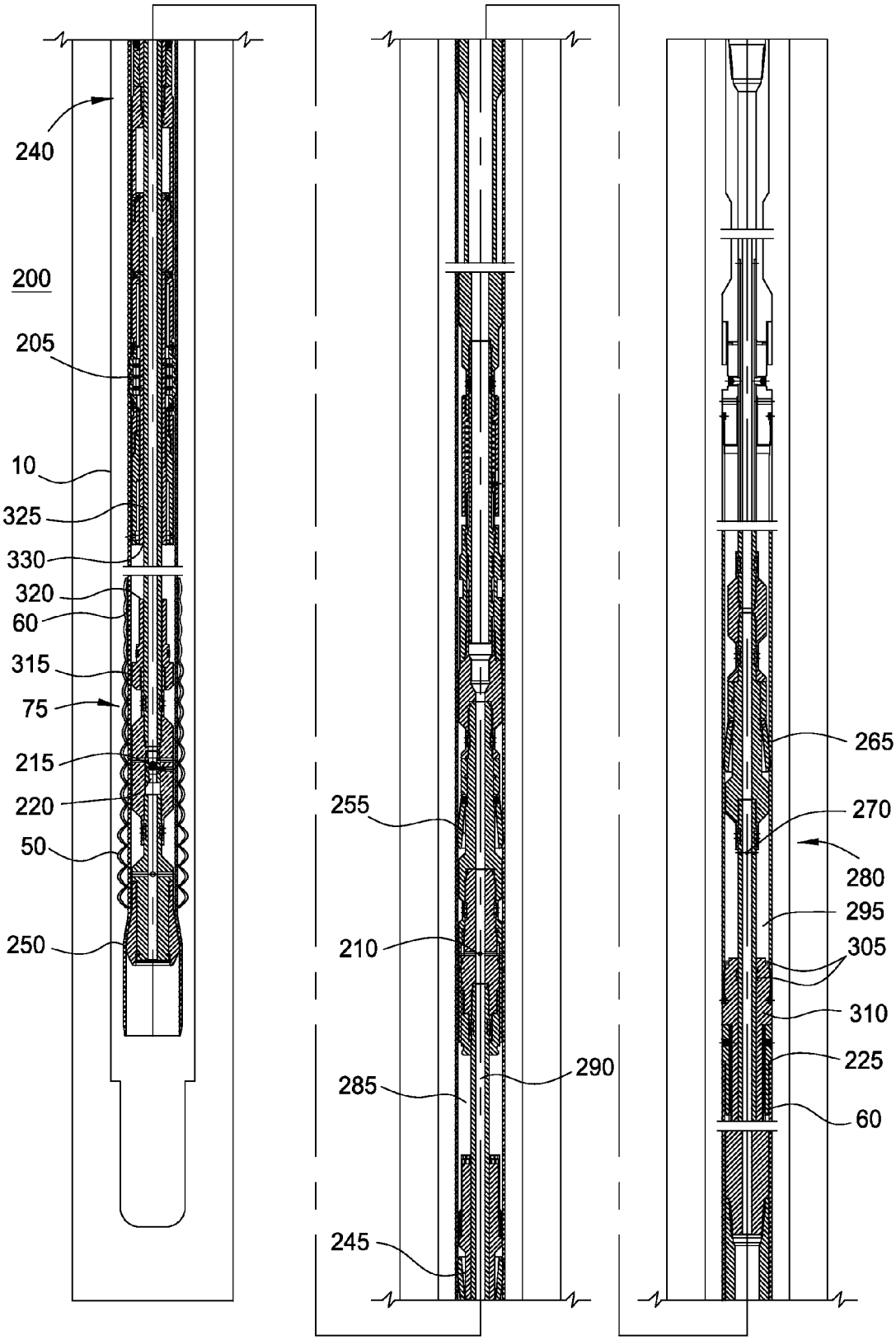
FIG. 4 is a view illustrating the expansion of the expandable tubular assembly.

FIG. 4 is a view illustrating the running tool 200 expanding the expandable tubular assembly 75. The movement of the expander 250 relative to the engagement device 205 is caused by jacks 240, 280. As shown in FIG. 4, the flow of fluid through the bore 230 is restricted by blocking member 215 on the seat 220. As a result, a portion of the fluid pumped into the bore 230 enters a chamber 285 of the first jack 240 via the port 210. The chamber 285 is defined between the cups 245, 255 of the first jack 240. The cup 255 is operatively attached to the expander 250 by a mandrel 290 and the cup 245 is operatively attached to the engagement device 205. As the chamber 285 of the first jack 240 fills with fluid, the cup 255 moves relative to the cup 245, which causes the expander 250 (and the mandrel 290) to move relative to the engagement device 205. A portion of the fluid in the bore 230 also enters the chamber 295 of the second jack 280 via the port 270. The chamber 295 of the second jack 280 is defined between the cup 265 and seals 305 on the annular member 310 (FIG. 3A). The cup 265 is operatively attached to the expander 250 and the annular member 310 is operatively attached to the support shoulder 225 that is engaged with the upper portion of the tubular 60 of the expandable tubular assembly 75. As the chamber 295 of the second jack 280 fills with fluid, the cup 265 moves relative to the annular member 310, which causes the expander 250 to move relative to the engagement device 205. As set forth herein, the engagement device 205 is configured to support the expandable tubular assembly 75 while the anchor portion 50 is being activated by the expander 250. Also shown in FIG. 4 is a releasing sleeve 315 that is configured to release the engagement device 205 in the running tool 200. The releasing sleeve 315 moves with the expander 250 through the expandable tubular assembly 75. The releasing sleeve 315 includes a shoulder 320 that is configured to engage a shoulder 330 of a locking mandrel 325 in the engagement device 205.

Figure 5:
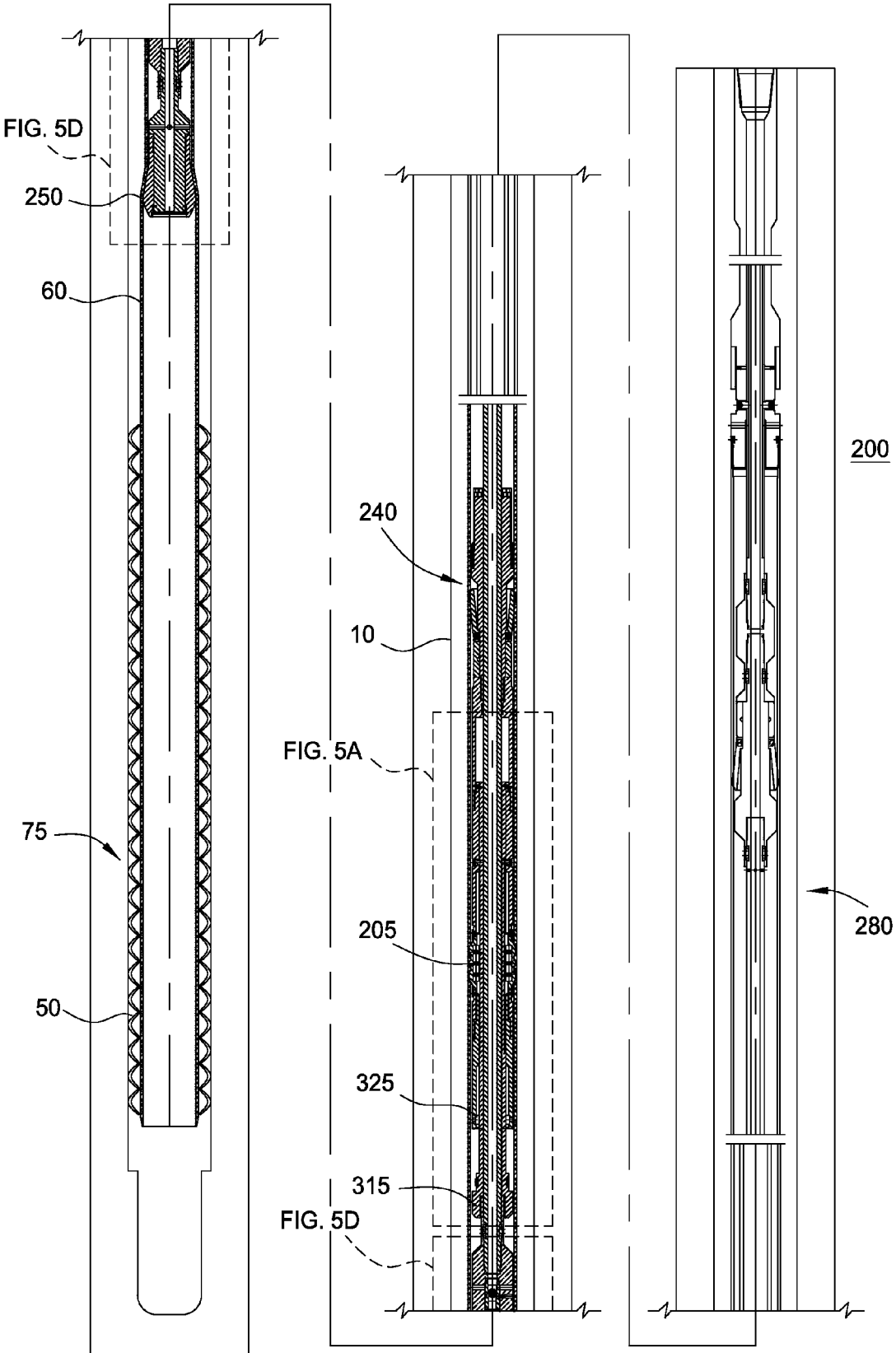
FIG. 5 is a view illustrating the release of an engagement device in the running tool.
Figure 5A:
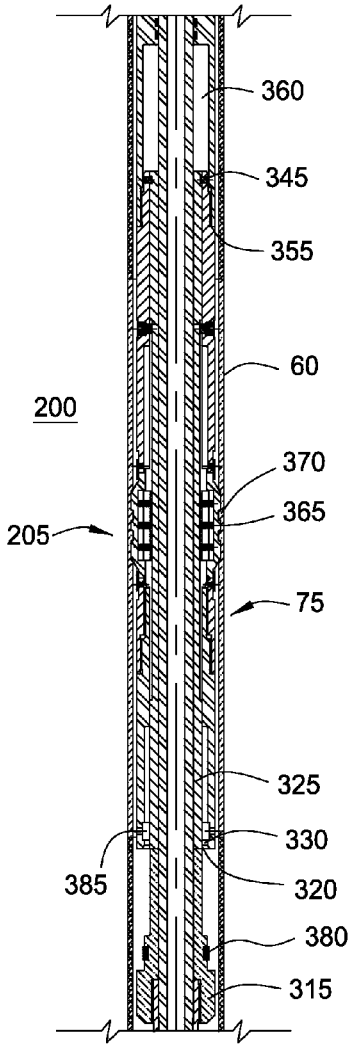
FIGS. 5A-5C are views illustrating the releasing process of the engagement device.
Figure 5B:
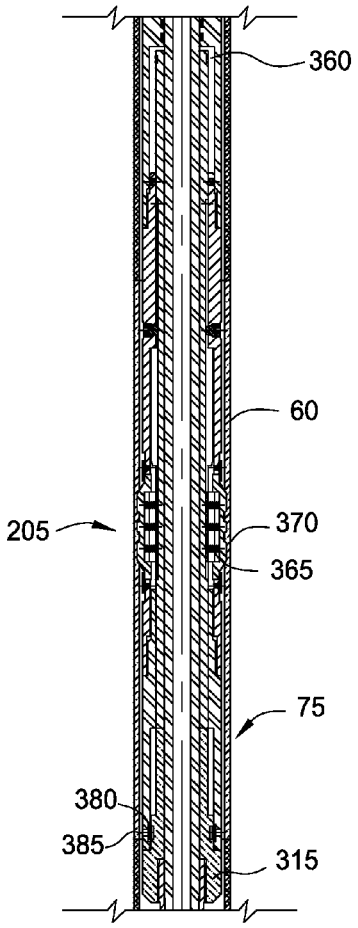
Figure 5C:
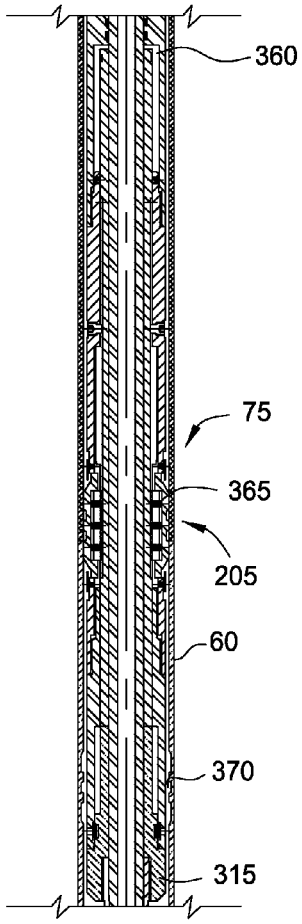

FIG. 5 is a view illustrating the release of the engagement device 205 in the running tool 200. The expander 250 moves through the expandable tubular assembly 75 until the anchor portion 50 of the expandable tubular assembly 75 is expanded radially outward into engagement with the borehole 10. At this point, the anchor portion 50 can support the expandable tubular assembly 75 in the borehole 10, and the engagement device 205 may be released from engagement with the expandable tubular assembly 75.

The releasing process of the engagement device 205 is shown in FIGS. 5A-5C. The releasing process begins when the shoulder 320 of the releasing sleeve 315 contacts the shoulder 330 of the locking mandrel 325 as shown in FIG. 5A. As set forth herein, the releasing sleeve 315 moves with the expander 250. The releasing sleeve 315 is positioned within the running tool 200 such that the releasing sleeve 315 engages the locking mandrel 325 at a point after the expander 250 has expanded the anchor portion 50 and the jacks 240, 280 are near the end of their stroke. In other words, the releasing sleeve 315 automatically releases the engagement device 205 at a point after the expander 250 has expanded the anchor portion 50

The releasing sleeve 315 applies a force on the locking mandrel 325 as the expander 250 continues to move through the expandable tubular assembly 75. At a predetermined force, a releasable connection 345, such as a shear pin, releases a connection between the locking mandrel 325 and a body portion 355 of the running tool 200. After the connection 345 has been released, the locking mandrel 325 moves from under drag blocks 365 and into space 360 as shown in FIG. 5B. The movement of the locking mandrel 325 allows the drag blocks 365 to collapse radially inward, which disengages the drag blocks 365 from grooves 370 in the tubular 60 of the expandable tubular assembly 75 as shown in FIG. 5C. At this point, the engagement device 205 is released from engagement with the expandable tubular assembly 75. The releasing sleeve 315 also includes a ring member 380 that is configured to engage a groove 385 in a body portion of the running tool 200 as shown in FIG. 5B. The engagement of the ring member 380 and the groove 385 locks the locking mandrel 325 to the body portion so that the locking mandrel 325 can no longer move under the drag blocks 365 to extend the drag blocks 365.

Figure 6A:
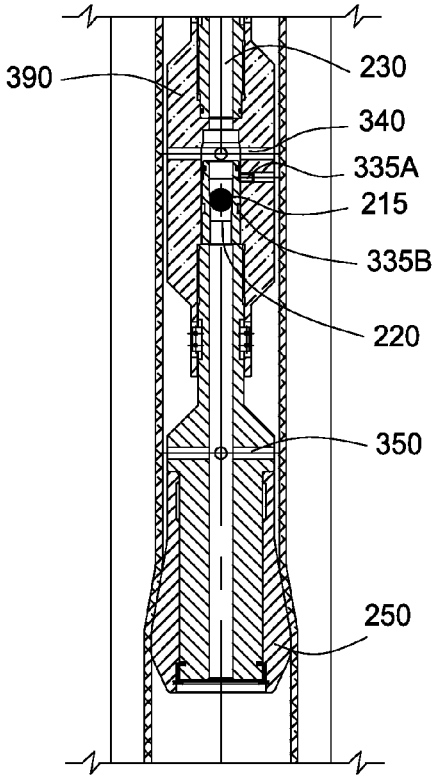
FIG. 6A is an enlarged view of the by-pass port in an opened position.
Figure 6:
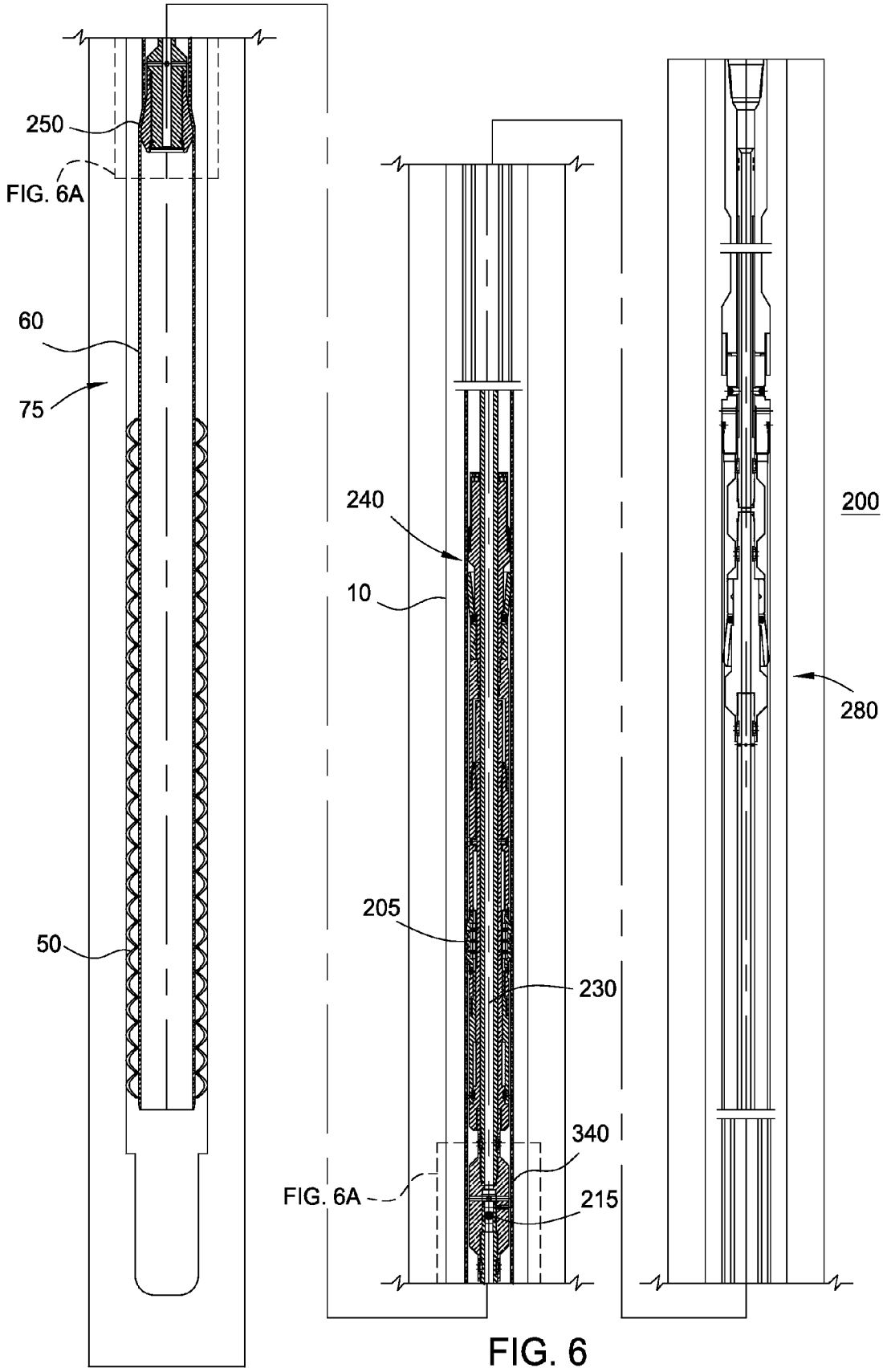
FIG. 6 is a view illustrating the opening of the by-pass port in the running tool.

FIG. 6 is a view illustrating the opening of a by-pass port 340 in the running tool 200. As shown in FIG. 6, the jacks 240, 280 are extended and the blocking member 215 continues to block the flow of fluid through the bore 230.

Figure 5D:
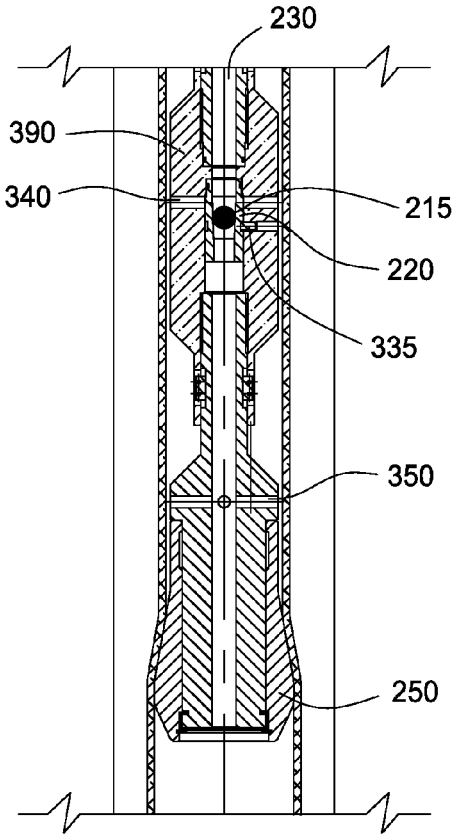
FIG. 5D is an enlarged view of a by-pass port in a closed position.

FIG. 5D is an enlarged view of the by-pass port 340 in a closed position and FIG. 6A is an enlarged view of the by-pass port 340 in an opened position. As shown in FIG. 5D, the blocking member 215 is in the seat 220. The seat 220 is an annular member that is connected to a mandrel 390 by a releasable connection 335. As shown, the seat 220 blocks the by-pass port 340 that is formed in the mandrel 390. As such, no fluid can enter into the by-pass port 340. To open the by-pass port 340, fluid is introduced into the bore 230 and fluid pressure increases in the bore 230. At a predetermined pressure, such as 5000 psi, the releasable connection 335 between the seat 220 and the mandrel 390 is released, which allows the seat 220 (and blocking member 215) to move relative to the mandrel 390 to expose the by-pass port 340 as shown in FIG. 6A. A fluid pathway is thus created to allow fluid to move from the bore 230 into the by-pass port 340 and out through a port 350 to a location below the running tool 200. As a result, fluid pumped into the running tool 200 may by-pass the blocking member 215 and exit the bottom of the tool 200.

Figure 7:
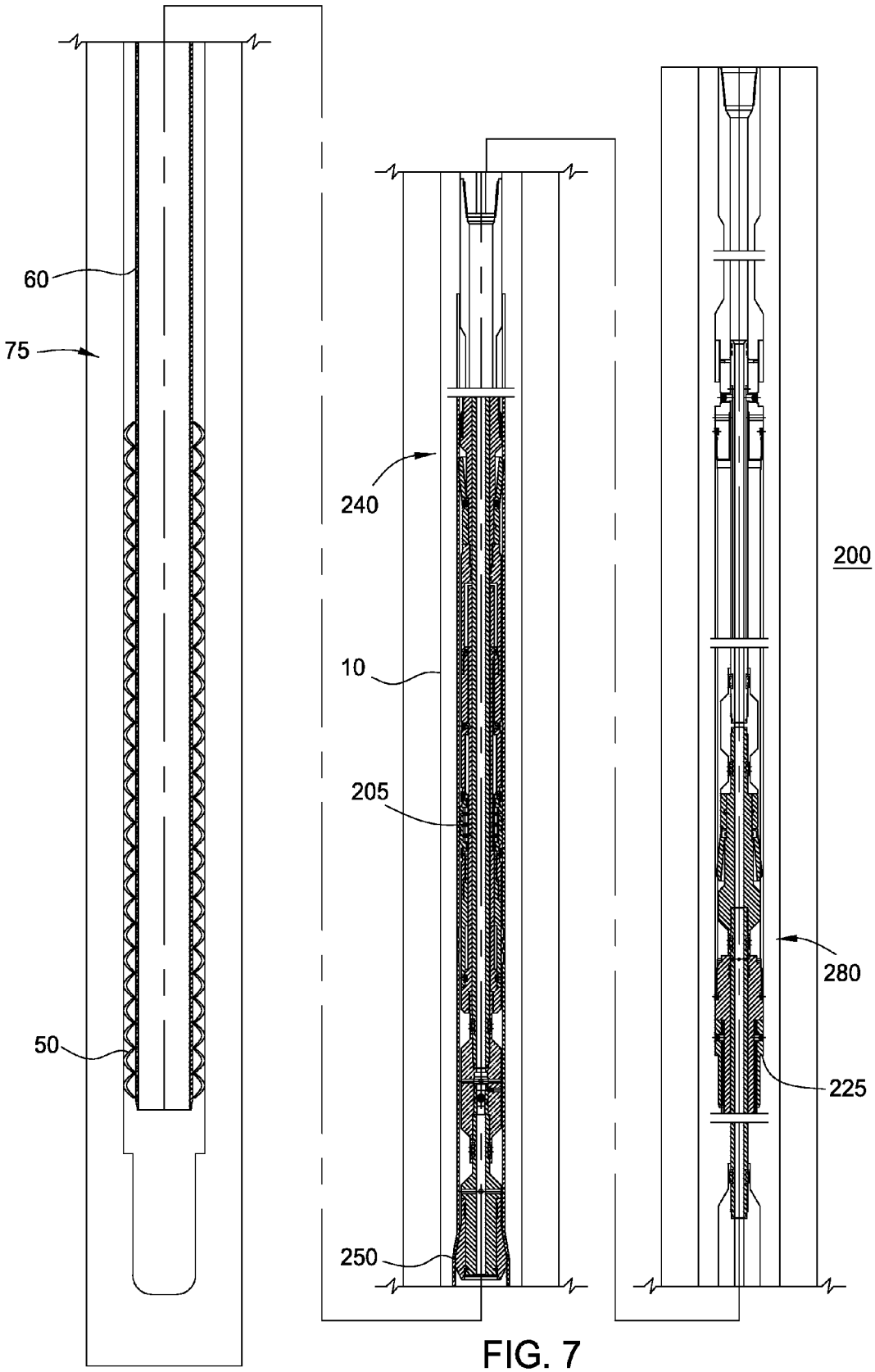
FIG. 7 is a view illustrating the running tool in the expandable tubular assembly during the expansion operation.

FIG. 7 is a view illustrating the running tool 200 expanding the expandable tubular assembly 75. The running tool 200 continues to expand the expandable tubular assembly 75 after the jacks 240, 280 have completed their strokes by mechanically pulling the running tool 200. As the running tool 200 is pulled, the jack 280 is moved (i.e., restroked) from the extended position to the retracted position. In other words, the jack 280 moves back to the initial run-in position as shown in FIG. 2. The running tool 200 expands the rest of the expandable tubular assembly 75 by mechanically pulling the running tool 200. After the expandable tubular assembly 75 has been expanded, the running tool 200 is removed from the borehole 10.

Figures 8, 9, 10:
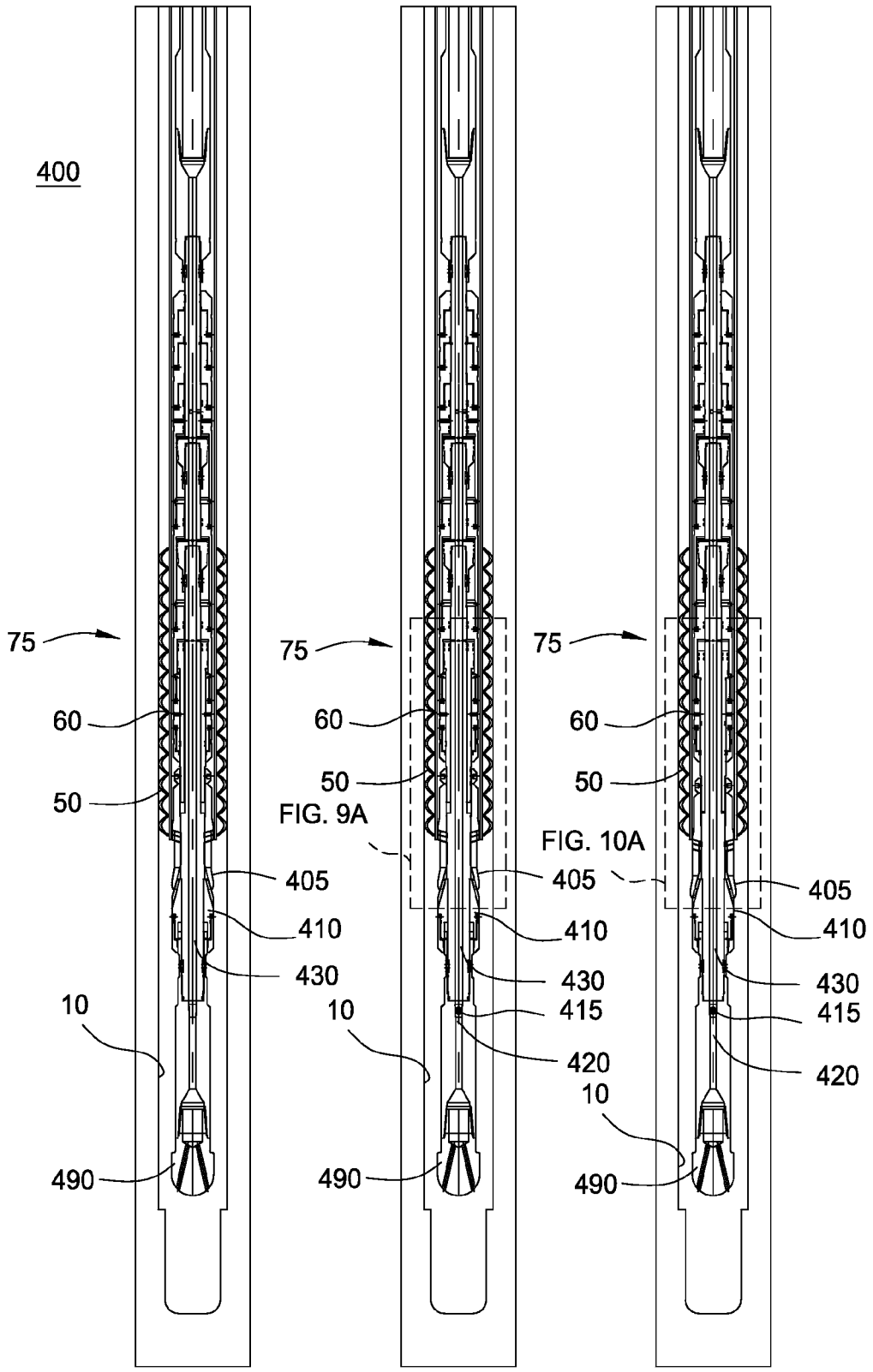
FIG. 8 is a view illustrating an expander tool of the expansion system being lowered into the expandable tubular assembly.
FIG. 9 is a view illustrating an expander of the expander tool in a retracted position.
FIG. 10 is a view illustrating the expander of the expander tool in an expanded position.

FIG. 8 is a view illustrating the expander tool 400 of the expansion system 100 being lowered into the expandable tubular assembly 75. After the running tool 200 has been removed from the borehole 10, the expander tool 400 is positioned within the expandable tubular assembly 75 in order to expand the tubular 60 from the first diameter to the second larger diameter. As shown, the expander tool 400 is located within the expandable tubular assembly 75 such that the ramped portion 410 and the second expander 405 are disposed below the end of the expandable tubular assembly 75.

FIG. 9 is a view illustrating the second expander 405 of the expander tool 400 in a retracted position. FIG. 10 is a view illustrating the second expander 405 of the expander tool 400 in an expanded position. The second expander 405 may include a plurality of individual segments that are configured to spread apart as the second expander 405 moves relative to the ramped portion 410. Each segment of the second expander 405 may include an extension member that is configured to interact with a respective groove in the ramped portion 410 as the second expander 405 moves between the retracted position and the expanded position.

Figure 9A:
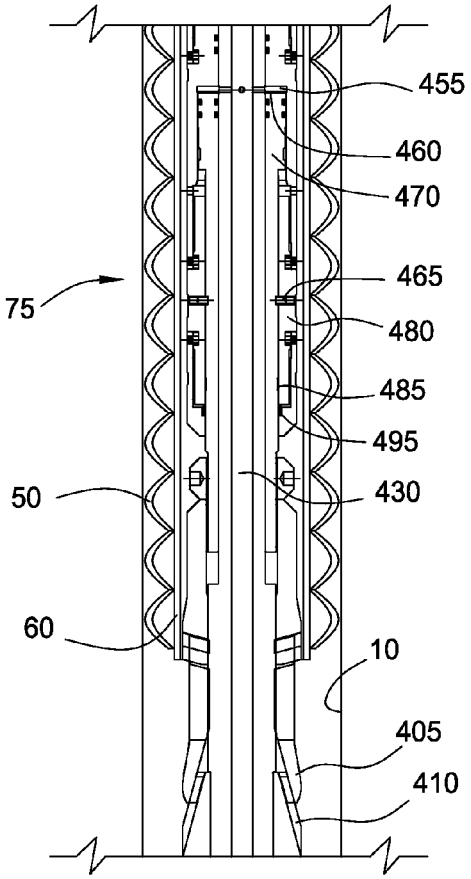
FIG. 9A is an enlarged view illustrating the expander of the expander tool in the retracted position.
Figure 10A:
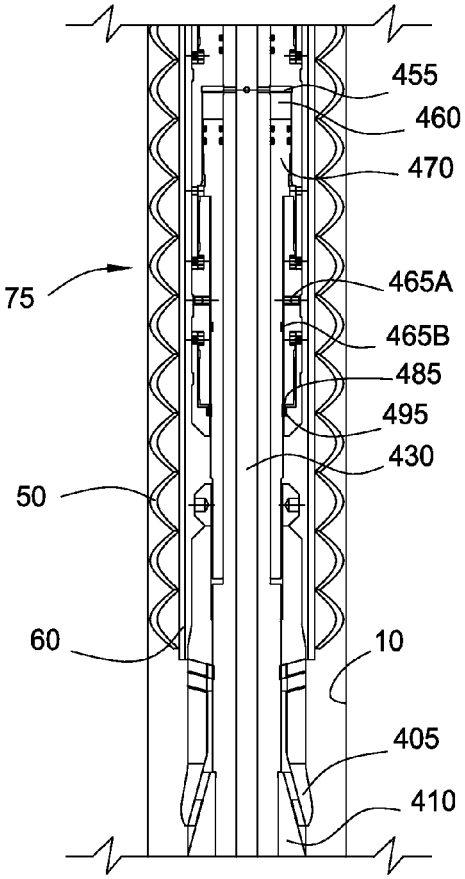
FIG. 10A is an enlarged view illustrating the expander of the expander tool in the expanded position.

After the expander tool 400 is positioned within the expandable tubular assembly 75, a blocking member 415, such as a ball or a dart, is dropped into a bore 430 in the expander tool 400 and lands on a seat 420, which blocks the flow of fluid through the expander tool 400. Thereafter, fluid pumped into the bore 430 of the expander tool 400 is directed through port 455 into a chamber 460 as shown in FIG. 9A. As the chamber 460 enlarges due to the fluid, a mandrel 470 applies a force on a releasable connection 465 between the mandrel 470 and a body member 480. At a predetermined force, the releasable connection 465 releases the connection between the mandrel 470 and the body member 480, which allows the mandrel 470 to move relative to the body member 480 as shown in FIG. 10A. The mandrel 470 is connected to the second expander 405. Thus, the movement of the mandrel 470 causes the second expander 405 to move from the retracted position to the expanded position as the second expander 405 is urged up the ramped portion 410. The second expander 405 is locked in the expanded position by aligning and engaging a ring member 495 attached to the body member 480 with a groove 485 formed on the mandrel 470 as shown in FIGS. 9A and 10A.

Figure 11:
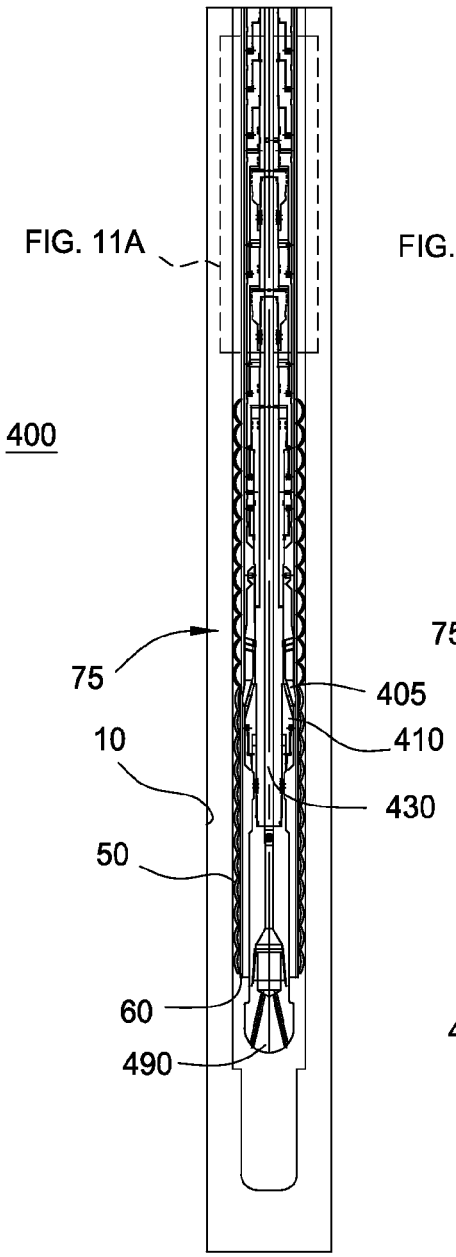
FIG. 11 is a view illustrating the expander tool expanding the expandable tubular assembly.

FIG. 11 is a view illustrating the expander tool 400 expanding the expandable tubular assembly 75. After the second expander 405 is locked in the expanded position, the pressure in the expander tool 400 is released. Thereafter, the expander tool 400 is mechanically pulled through the expandable tubular assembly 75 to expand the expandable tubular assembly 75 to the second diameter.

Figure 12:
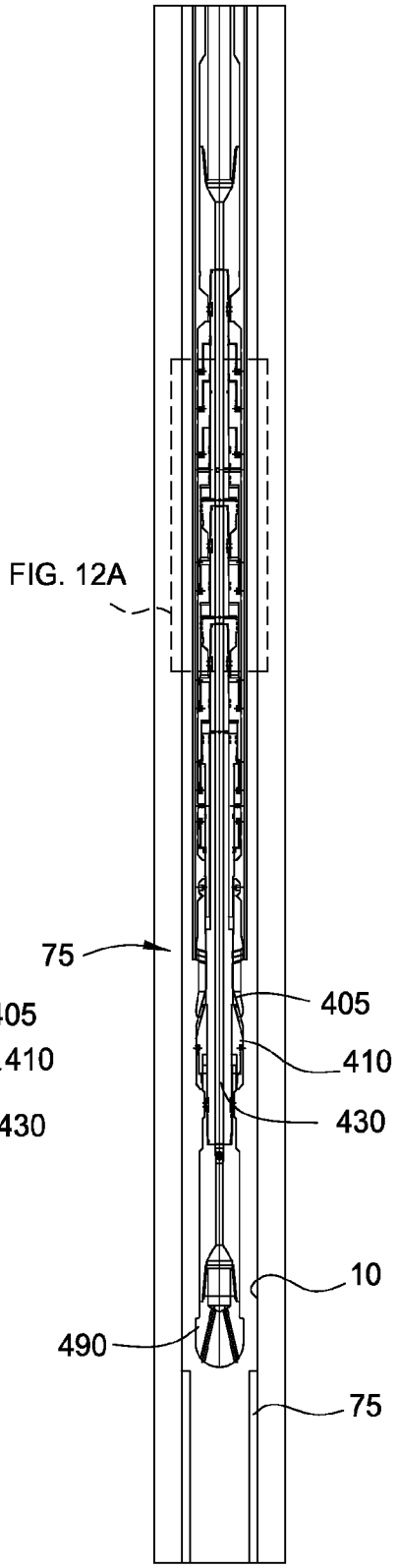
FIG. 12 is a view illustrating the expander tool removed from the expandable tubular assembly.
Figure 11A:
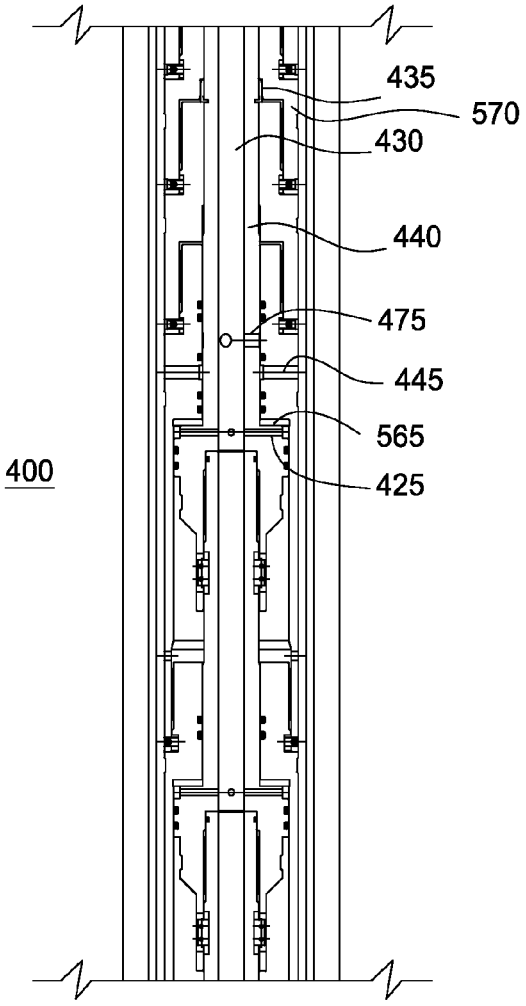
FIG. 11A is an enlarged view illustrating a hydraulic release mechanism of the expander.
Figure 12A:
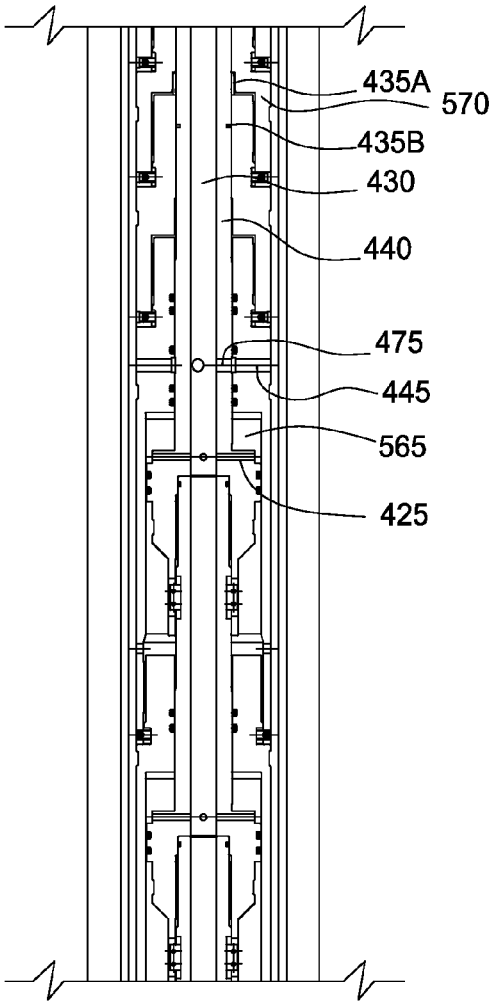
FIG. 12A is an enlarged view illustrating the activation of the hydraulic release mechanism of the expander.

FIG. 12 is a view illustrating the expander tool 400 after expansion of the expandable tubular assembly 75. The expander tool 400 is urged through the length of the expandable tubular assembly 75 and then positioned within the borehole 10 as shown. At this point, the second expander 405 is unlocked and moves from the expanded position to the retracted position by hydraulic activation. FIGS. 11 and 11A illustrate the second expander 405 in the expanded position and FIGS. 12 and 12A illustrate the second expander 405 in the retracted position. The unlocking of the second expander 405 will be described in relation to FIGS. 11A and 12A.

As shown in FIG. 11A, the bore 430 of the expander tool 400 is in fluid communication with a port 425. To unlock the second expander 405, fluid is pumped down the bore 430 and enters chamber 565 via the port 425. As the chamber 565 enlarges due to the fluid, a mandrel 440 applies a force on a releasable connection 435, such as a shear ring, between the mandrel 440 and a body member 570. At a predetermined force, the releasable connection 435 releases the connection between the mandrel 440 and the body member 565, which allows the mandrel 440 to move relative to the body member 570 as shown in FIG. 12A. The mandrel 440 is connected to the ramped portion 410. Thus, the movement of the mandrel 440 causes the ramped portion 410 to move from under the second expander 405, which causes the second expander 405 to move from the expanded position to the retracted position as shown in FIG. 12. In addition, as the mandrel 440 moves relative to the body member 570, a port 475 in the mandrel 440 aligns with a port 445 in the body member 570 (compare FIGS. 11A and 12A), which allows fluid communication within the expander tool 400. Thereafter, the expander tool 400 may be removed from the borehole 10.

Figure 13A:
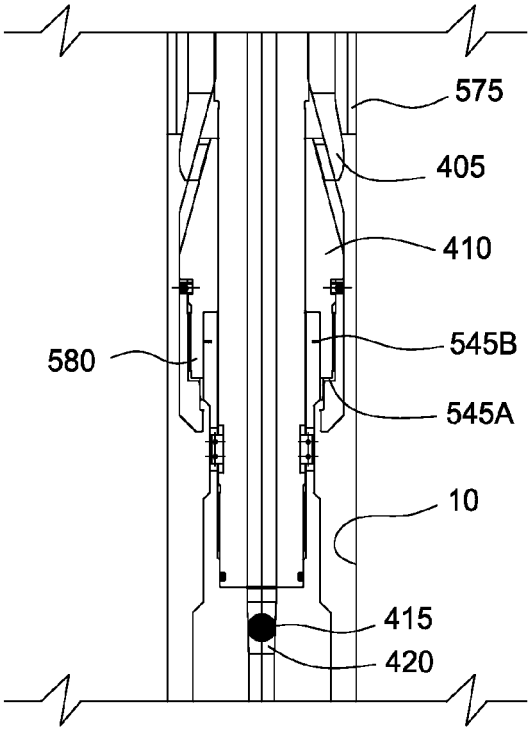
FIG. 13A is an enlarged view illustrating the activation of a mechanical release mechanism of the expander.
Figure 13:
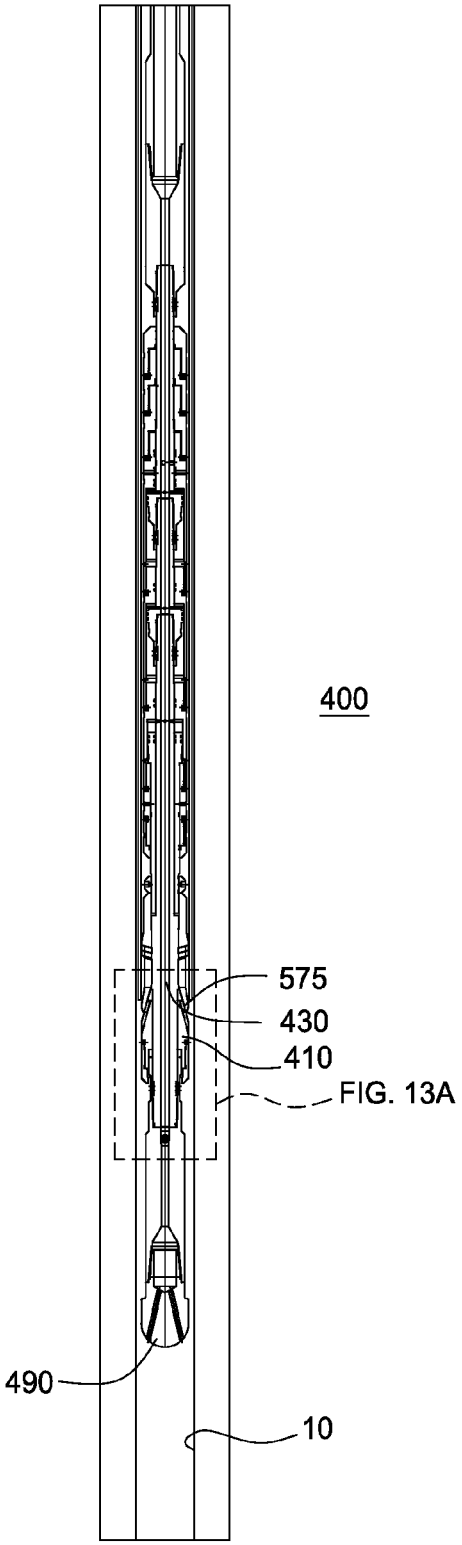
FIG. 13 is a view illustrating the expander tool positioned adjacent a casing string.

FIG. 13 is a view illustrating the second expander 405 of the expander tool 400 mechanically moved from the expanded position to the retracted position. If the second expander 405 is unable to be hydraulically unlocked as set forth in FIGS. 11A and 12A, the second expander 405 may be mechanically unlocked. To unlock the second expander 405 mechanically, the expander tool 400 is pulled up until the expander tool 400 contacts a casing 575 (i.e., another expanded tubular assembly or a parent casing). As the expander tool 400 is pulled relative to the casing 575, a force is applied to a releasable connection 545, such as a shear ring, between the ramp portion 410 and a body member 580. At a predetermined force, the releasable connection 545 releases the connection between the ramp portion 410 and the body member 580 which allows the ramp portion 410 to move relative to the body member 580 as shown in FIG. 13A. In turn, the ramped portion 410 moves from under the second expander 405 which causes the second expander 405 to move from the expanded position to the retracted position. Thereafter, the expander tool 400 may be removed from the borehole 10.

Figure 14A:
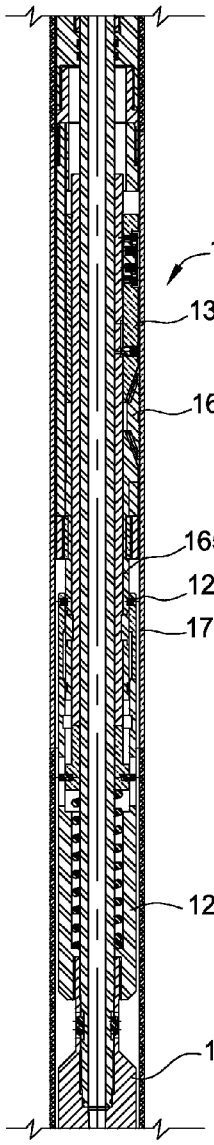
FIGS. 14A-14D are views illustrating the releasing process of a slip arrangement.
Figure 14B:
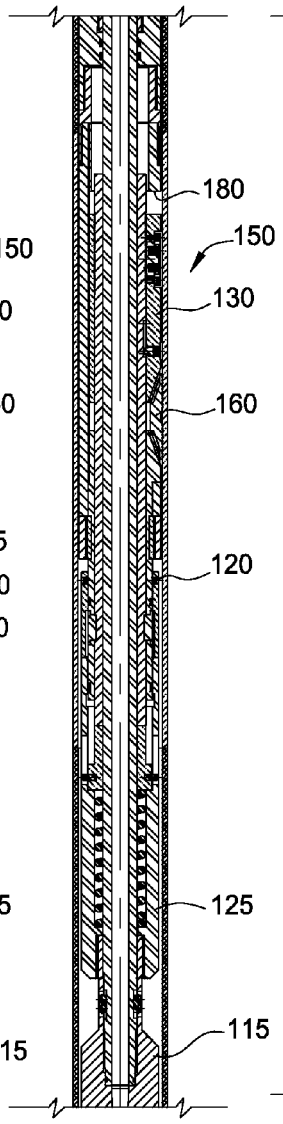
Figure 14C:
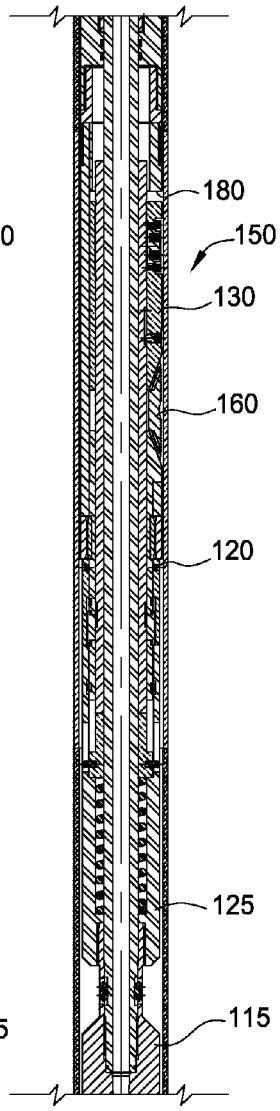
Figure 14D:
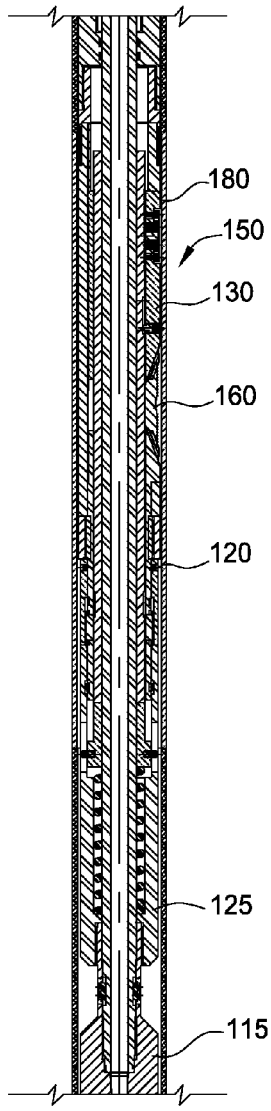

FIGS. 14A-14D are views illustrating a slip arrangement 150. The slip arrangement 150 is used as the engagement device 205 between the tool 200 and the expandable tubular assembly 75. The slip arrangement 150 is a different embodiment of the engagement device 205 shown in FIGS. 5A-5C which is illustrated as a drag block arrangement. The slip arrangement 150 includes a set of slips 160 that move between an extended position and a retracted position. In FIG. 14A, the slips 160 are in the extended position and engaged with the tubular of the expandable tubular assembly. To move the slips 160 from the extended position to the retracted position, a releasing mechanism 115 is mechanically pulled in the direction of the slips 160. The releasing mechanism 115 causes a shear pin 120 to release a holding sleeve 165. At this point, a spring loaded releasing sleeve 125 moves back. In FIG. 14B, the shear pin 120 has been sheared, and further mechanical pull on the releasing member 115 causes the holding sleeve 165 to move an upper slip retainer 130 toward a shoulder 180. In FIG. 14C, the upper slip retainer 130 moves relative to the slips 160, which causes the slips 160 to move radially inward. In FIG. 14D, the upper slip retainer 130 has contacted the shoulder 180, and the spring loaded releasing sleeve 125 has extended, which causes the slips 160 to move to the retracted position. Thereafter, the tool 200 may be moved through the expandable tubular assembly similar to FIG. 1C.

FIGS. 15A-15D are views illustrating a running tool 535. The tool 535 is used to lower and expand an expandable tubular assembly 500 in a single trip. The running tool 535 includes similar components as the expansion system 100 described in FIGS. 1-13.

Figures 15A, 15B, 15C, 15D:
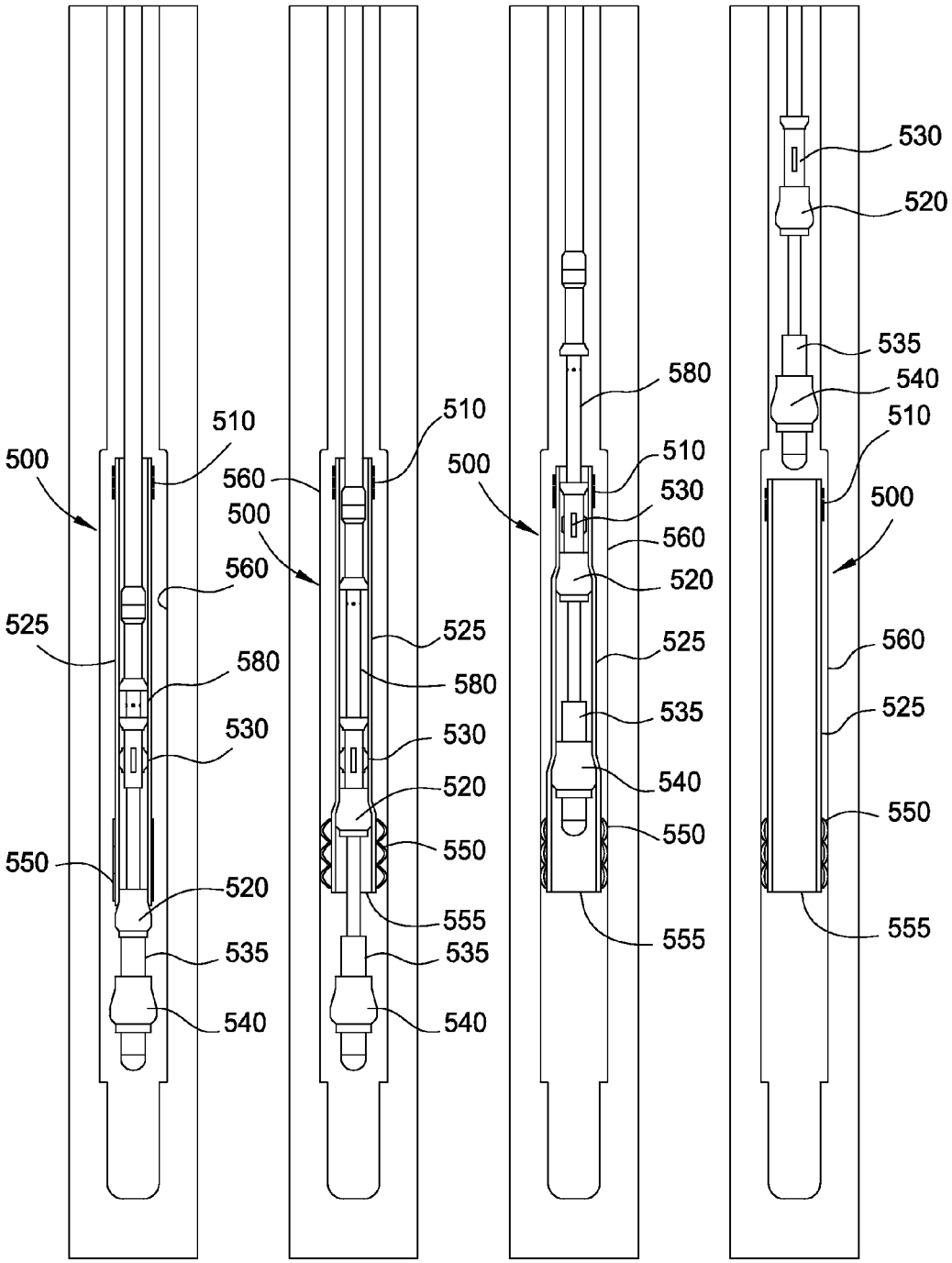
FIGS. 15A-15D are views illustrating the steps of expanding an expandable tubular assembly in a borehole using a running tool.

FIG. 15A illustrates the placement of the expandable tubular assembly 500 adjacent an under-reamed portion of the borehole 560. The expandable tubular assembly 500 is connected to the tool 535 by a releasable engagement device 530, such as a latch, collet, slips, thread, shear member or any other suitable mechanism. The expandable tubular assembly 500 includes an anchor portion 550 and a seal portion 510 disposed around a tubular 525. The anchor portion 550 is positioned between the engagement device 530 (i.e., fixed point) and an end 555 (i.e., free point) of the tubular 525.

FIG. 15B illustrates a first expander 520 expanding the tubular 525 adjacent the anchor portion 550. The first expander 520 is configured to move relative to the engagement device 530 by a hydraulic or mechanical moving device, such as jack 580. As the first expander 520 expands the tubular 525, the length between the end 525 of the tubular 525 and the engagement device 530 changes from a first length to a second shorter length, which causes the anchor portion 550 to activate. In other words, the tubular 525 becomes axially shorter as the tubular 525 is expanded radially. The reduction in the length of the tubular 525 occurs between the fixed end (engagement device 530) and the free end 505.

FIG. 15C illustrates an optional second expander 540 further expanding the expandable tubular assembly 500. After the expandable tubular assembly 500 is attached to the borehole 560 by the anchor portion 550, the engagement device 530 is released and the running tool 535 is mechanically pulled upward to expand (or further expand) the tubular 525 of the expandable tubular assembly 500 by using the first expander 520 and the second expander 540. In another embodiment, the jack 580 may be used to move both the first expander 520 and the second expander 540 through the expandable tubular assembly 500 in addition to the mechanical over pull or in place of the mechanical over pull. FIG. 15D illustrates the removal of the running tool 535 after expansion of the expandable tubular assembly 500.

While the foregoing is directed to embodiments of the present invention, other and further embodiments of the invention may be devised without departing from the basic scope thereof, and the scope thereof is determined by the claims that follow.

The invention claimed is:

1. A system for expanding a tubular having an anchor portion in a borehole, the system comprising:

a running tool configured to position the tubular in the borehole, the running tool including:

a first expander configured to activate the anchor portion by expanding the tubular to a first diameter, wherein the anchor portion is configured to support the tubular in the borehole upon activation; and an engagement device that is configured to selectively engage the tubular, wherein the engagement device is configured to be automatically released from the tubular at a point after the anchor portion has been activated; and a second expander configured to expand the tubular to a second larger diameter, wherein the second expander is movable between a retracted position and an expanded position, and wherein the anchor portion is further activated when the tubular is expanded to a second larger diameter.

2. The system of claim 1, wherein the running tool includes one or more jacks to move the first expander relative to the engagement device.

3. The system of claim 1, wherein the first expander is configured to activate the anchor portion while the engagement device holds the tubular.

4. The system of claim 1, wherein the second expander is attached to the running tool.

5. The system of claim 1, wherein the second expander moves between the retracted position and the expanded position as the second expander moves along a ramped portion.

6. The system of claim 1, wherein a drill bit is disposed below the second expander.

7. A method of expanding a tubular having an anchor portion in a borehole, the method comprising:

positioning the tubular in the borehole using a running tool that includes a first expander and an engagement device for retaining the tubular;

activating the anchor portion by expanding a portion of the tubular to a first diameter using the first expander while the engagement device supports the tubular;

releasing the engagement device from the tubular and expanding the remaining portion of the tubular to the first diameter using the first expander;

positioning a second expander in the tubular; and expanding the tubular to a second larger diameter by using the second expander.

8. The method of claim 7, further comprising activating one or more jacks in the running tool to move the first expander relative to the engagement device.

9. The method of claim 7, further comprising automatically releasing the engagement device from the tubular after the anchor portion is activated.

10. The method of claim 7, wherein the second expander is movable between a retracted position and an expanded position.

11. The method of claim 10, wherein the second expander is positioned in the tubular such that the second expander is disposed outside of the tubular.

12. The method of claim 7, further comprising drilling a portion of the borehole with a drill bit attached to the second expander prior to expanding the tubular to the second larger diameter.

13. The method of claim 7, wherein the tubular is expanded to the first diameter and the second larger diameter in a single trip.

14. The method of claim 7, wherein the tubular is expanded to the first diameter and the second larger diameter in more than one trip.

15. A tool for expanding an open-hole anchor in a borehole, the tool comprising:

an engagement device configured to selectively engage a tubular portion of the open-hole anchor;

an expander configured to expand the open-hole anchor; and one or more jacks configured to move the expander relative to the engagement device in order to expand an anchor portion of the open-hole anchor, wherein the engagement device is configured to automatically disengage from the open-hole anchor in response to the anchor portion being expanded.

16. The tool of claim 15, wherein the one or more jacks move the expander through the anchor portion while the engagement device supports the tubular.

17. The tool of claim 15, wherein the engagement device includes drag blocks that engage grooves in the open-hole anchor.

18. The tool of claim 15, wherein the engagement device includes slips that engage a portion of the open-hole anchor.

19. The tool of claim 15, wherein the expander is mechanically pulled through the open-hole anchor after the anchor portion is expanded.

20. A system for use in a wellbore, the system comprising:

a tubular having an anchor portion, wherein the anchor portion is expandable in a radially-outward direction away from the tubular to support the tubular in the wellbore when the tubular is expanded to a first diameter;

a running tool configured to position the tubular in the wellbore, the running tool including a first expander configured to activate the anchor portion by expanding the tubular to the first diameter when moved in a first axial direction; and a second expander configured to expand the tubular to a second larger diameter when moved in the first axial direction, wherein the second expander is movable between a retracted position and an expanded position.

21. The system of claim 20, wherein the anchor portion is located proximate a bottom portion of the tubular.

22. The system of claim 20, wherein the tubular is expanded in an open-hole portion of the wellbore.

* * * * *